US005761571A

United States Patent [19]

Suzuki et al.

[11] Patent Number: 5,761,571

[45] Date of Patent: Jun. 2, 1998

[54] CONTROL DEVICE FOR AN ATTRACTION ROLLER

[75] Inventors: Takehiko Suzuki, Numazu; Toshihiko Ochiai; Toshiaki Miyashiro, both of Shizuoka-ken, all of Japan

[73] Assignee: Canon Kabushiki Kaisha, Tokyo, Japan

[21] Appl. No.: 728,850

[22] Filed: Oct. 10, 1996

[30] Foreign Application Priority Data

Oct. 13, 1995 [JP] Japan ..... 7-290627

[51] Int. Cl.[6] ..... G03G 21/00

[52] U.S. Cl. ..... 399/66; 399/302

[58] Field of Search ..... 399/66, 302, 303, 399/304, 308

[56] References Cited

U.S. PATENT DOCUMENTS

| | | | |
|---|---|---|---|
| 5,214,480 | 5/1993 | Aoki et al. | 399/314 |
| 5,249,023 | 9/1993 | Miyashiro et al. | 399/303 |
| 5,287,144 | 2/1994 | Takeda | 399/66 |
| 5,287,163 | 2/1994 | Miyashiro et al. | 399/66 |
| 5,508,796 | 4/1996 | Sasame et al. | 399/18 |
| 5,539,507 | 7/1996 | Miyashiro et al. | 399/298 |
| 5,659,842 | 8/1997 | Hasegawa et al. | 399/66 |

FOREIGN PATENT DOCUMENTS

| | | |
|---|---|---|
| 7-168460 | 7/1995 | Japan . |

*Primary Examiner*—Nestor Ramirez

*Attorney, Agent, or Firm*—Fitzpatrick, Cella, Harper & Scinto

[57] ABSTRACT

An image forming apparatus has an image bearing member, a transfer material bearing member for bearing a transfer material onto which an image can be transferred from the image bearing member, an attract member for electrostatically attracting the transfer material to the transfer material bearing member, and a constant voltage control for effecting constant voltage control of the attract member with predetermined voltage. The total impedance of an attract circuit including the attract member and the constant voltage control means is $10^6\Omega$ to $10^{10}\Omega$.

18 Claims, 10 Drawing Sheets

CONTROL DEVICE FOR AN ATTRACTION ROLLER

BACKGROUND OF THE INVENTION

1. Field of the Invention

The present invention relates to an image forming apparatus in which an image is transferred from an image bearing member onto a transfer material supported on a transfer material bearing member such as a transfer drum, and more particularly, it relates to an image forming apparatus suitable for forming a full-color image.

2. Related Background Art

There have been proposed image forming apparatuses in which an image is transferred from a photosensitive drum as an image bearing member onto a transfer material supported on a transfer drum as a transfer material bearing member. Such image forming apparatuses can be used to transfer a plurality of different color images from the image bearing member onto the transfer material in a superimposed fashion.

The transfer material is electrostatically absorbed or attracted to the transfer drum via an attract roller as an attract member. The transfer drum comprises, for example, a conductive core cylinder, an elastic layer coated on the core cylinder and a dielectric layer coated on the elastic layer, and the transfer material is attracted to the dielectric layer. When the image is transferred, transfer voltage is applied to the core cylinder.

In the above-mentioned conventional color image forming apparatuses, when environmental temperature and humidity are changed, capacities and resistances of the dielectric layer of the transfer drum and of the transfer material are also changed, transfer bias voltage and attract bias voltage are controlled in accordance with the environmental temperature and humidity. Accordingly, even when the resistance of the transfer material is changed, so long as the resistance is changed in accordance with the environmental temperature and humidity, a high quality image can be outputted.

However, if the resistance value of the transfer material is changed independently of the environmental temperature and humidity (for example, when the resistance value of the transfer material is small in a low temperature/humidity environment; more specifically, when the apparatus is installed in a relatively low temperature/humidity environment controlled by an air conditioner and the transfer materials are stored in a high temperature/humidity environment without any air conditioner and when the transfer material with high temperature is immediately used in the apparatus), there will occur poor image such as fog or poor transfer. The reason is that, since the resistance value of the transfer material is greatly changed between $10^5\Omega$ and $10^{10}\Omega$ in dependence upon the environmental temperature and humidity, kind of transfer material and/or lot of transfer materials and impedance of an attract circuit has an unchanged value of $10^2\Omega$ to $10^3\Omega$, an amount of charges (absorb current) applied to the transfer material during the attracting operation is greatly changed in accordance with the resistance value of the transfer material.

In the above-mentioned conventional image forming apparatuses, the toner image is transferred by potential difference between the photosensitive drum and the transfer drum. Thus, if the amount of charges applied to the transfer material during the attracting operation is changed, surface potential of the transfer drum will be also changed not to provide desired potential difference, thereby causing the poor image such as poor transferring. In particular, under the low temperature/humidity environment, if the resistance value of the transfer material is decreased below $10^8\Omega$, the poor transferring will frequently occur.

In the case where constant current control is effected in order to stabilize the attract current, when a transfer material having low resistance is passed through the image forming apparatus under the high temperature/humidity environment, the current leaks, through the transfer material, to members such as a transfer guide with which the transfer material is contacted during the sheet supplying operation, with the result that, even when the predetermined current is applied, the desired charges cannot be generated on the transfer material, thereby causing the poor attracting.

SUMMARY OF THE INVENTION

An object of the present invention is to provide an image forming apparatus in which a transfer material can stably be attracted to a transfer material bearing member electrostatically, regardless of an environment within which the apparatus is installed.

Another object of the present invention is to provide an image forming apparatus in which attract current can stably be supplied to obtain a high quality image even if resistance of a transfer material is changed.

The other objects and features of the present invention will be apparent from the following detailed explanation referring to the accompanying drawings.

DETAILED DESCRIPTION OF THE PREFERRED EMBODIMENTS

The present invention will now be explained in connection with embodiments thereof with reference to the accompanying drawings.

Figure 9:
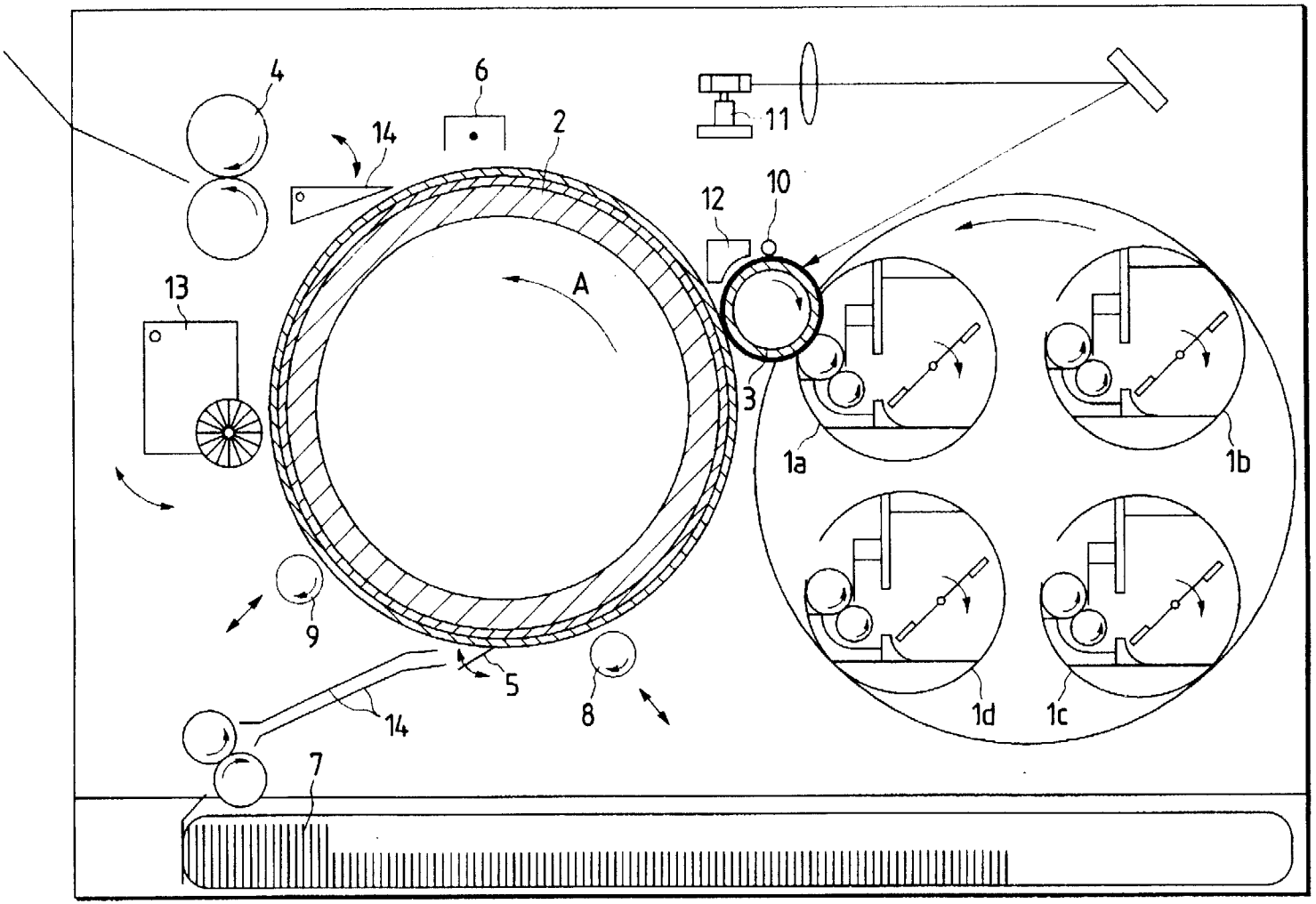
FIG. 9 is a schematic elevational sectional view of a color image forming apparatus according to the present invention.

FIG. 9 shows a color image forming apparatus of multi-transfer type according to one embodiment of the present invention.

An image bearing member (electrophotographic photosensitive drum) 3 is rotated in a direction shown by the arrow A; meanwhile, the drum is uniformly charged by a charge means 10, and then, a light image is illuminated onto the photosensitive drum 3 by a laser exposure device 11, thereby forming an electrostatic latent image on the drum 3. The latent image is visualized as a toner image by developing devices 1*a*, 1*b*, 1*c* and 1*d* containing yellow (Y) color toner, magenta (M) color toner, cyan (C) color toner and black (Bk) color toner, respectively.

Figure 10:
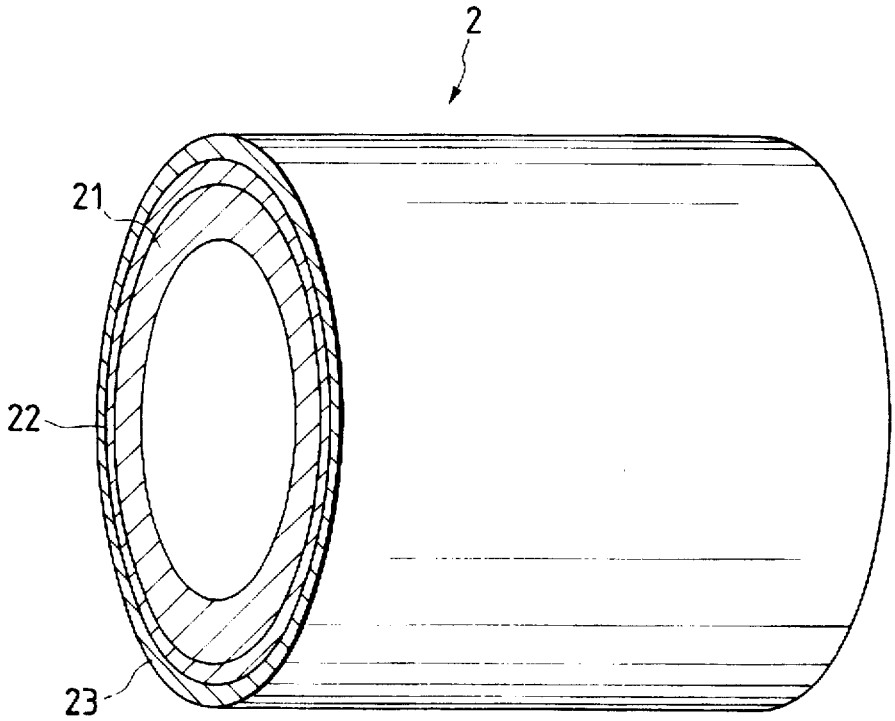
FIG. 10 is a sectional perspective view of a transfer drum of the color image forming apparatus of FIG. 9.

On the other hand a transfer material 7 guided by a transfer guide 14 is gripped and secured to a surface of a transfer drum (transfer material bearing member) 2 by grippers 5. Then, the transfer material is electrostatically attracted to the transfer drum by an attract roller (attract rotary member) 8. The transfer material 7 is conveyed into a nip between the attract roller 8 and the drum 2. The toner images successively formed on the photosensitive drum 3 are successively transferred onto the transfer material 7 wound around the transfer drum 2 (in the illustrated embodiment, as shown in FIG. 10, the drum 2 comprises a conductive aluminium core cylinder (as an electrode) 21, a conductive elastic layer 22 coated on the core cylinder and a dielectric layer 23 coated on the elastic layer). The core cylinder 21 is provided on at least entire back portion of the dielectric layer 23 on which the transfer material is born.

Further explaining, an electrostatic latent image formed on the photosensitive drum 3 by the exposure on the basis of an image signal corresponding to a first color is visualized, for example, by the developing device is containing the yellow (Y) color toner as an yellow toner image, and then the yellow toner image is transferred onto the transfer material 7 held by the transfer drum 2. Then, after the residual toner remaining on the photosensitive drum 3 is removed by a cleaner 12, an electrostatic latent image corresponding to a second color is formed on the photosensitive drum 3 by exposure on the basis of an image signal corresponding to the second color, and the latent image is visualized, for example, by the developing device 1*b* containing the magenta (M) color toner as a magenta toner image, and then the magenta toner image is transferred onto the transfer material 7 (to which the first color toner image was transferred) held by the transfer drum 2 in a superimposed fashion.

By repeating similar operations, a third color cyan (C) toner image and a fourth color black (Bk) toner image are successively transferred onto the transfer material 7 on the transfer drum 2 in a superimposed fashion. Thereafter, electricity is removed from the transfer material 7 by a separation and electricity removal device 6, and then the transfer material is separated from the transfer drum 2 by a separation pawl 14. Then, the transfer material is sent to a fixing device 4, where the toner images are fixed to the transfer material as a permanent full-color image. After the transfer material 7 is separated from the transfer drum, the residual toner remaining on the transfer drum 2 is removed by a transfer member cleaner 13, and the electricity is removed from the transfer drum by an electricity removal roller 9, thereby initializing the transfer drum.

Incidentally, the attract roller 8 and the electricity removal roller 9 are spaced apart from the transfer drum while the transfer material having the toner image(s) thereon is being held by the transfer drum, but, they are contacted with the transfer drum 2 when the attracting operation and the electricity removing operation are effected, respectively.

Next, an attract circuit including the attract roller 8 and a power source for applying voltage to the attract roller 8 will be explained.

(First embodiment)

A first embodiment of the present invention will be described with reference to FIGS. 1 and 2. As mentioned above, when the resistance value of the transfer material is changed between $10^5\Omega$ and $10^{10}\Omega$ and the total impedance of the attract circuit has an unchanged value of $10^2\Omega$ to $10^3\Omega$, if the resistance of the transfer material is greatly changed, attract current will also be changed greatly. In this embodiment, in order to eliminate such inconvenience, the total impedance of the attract circuit is set to $10^6\Omega$ to $10^{10}\Omega$.

Figure 1:
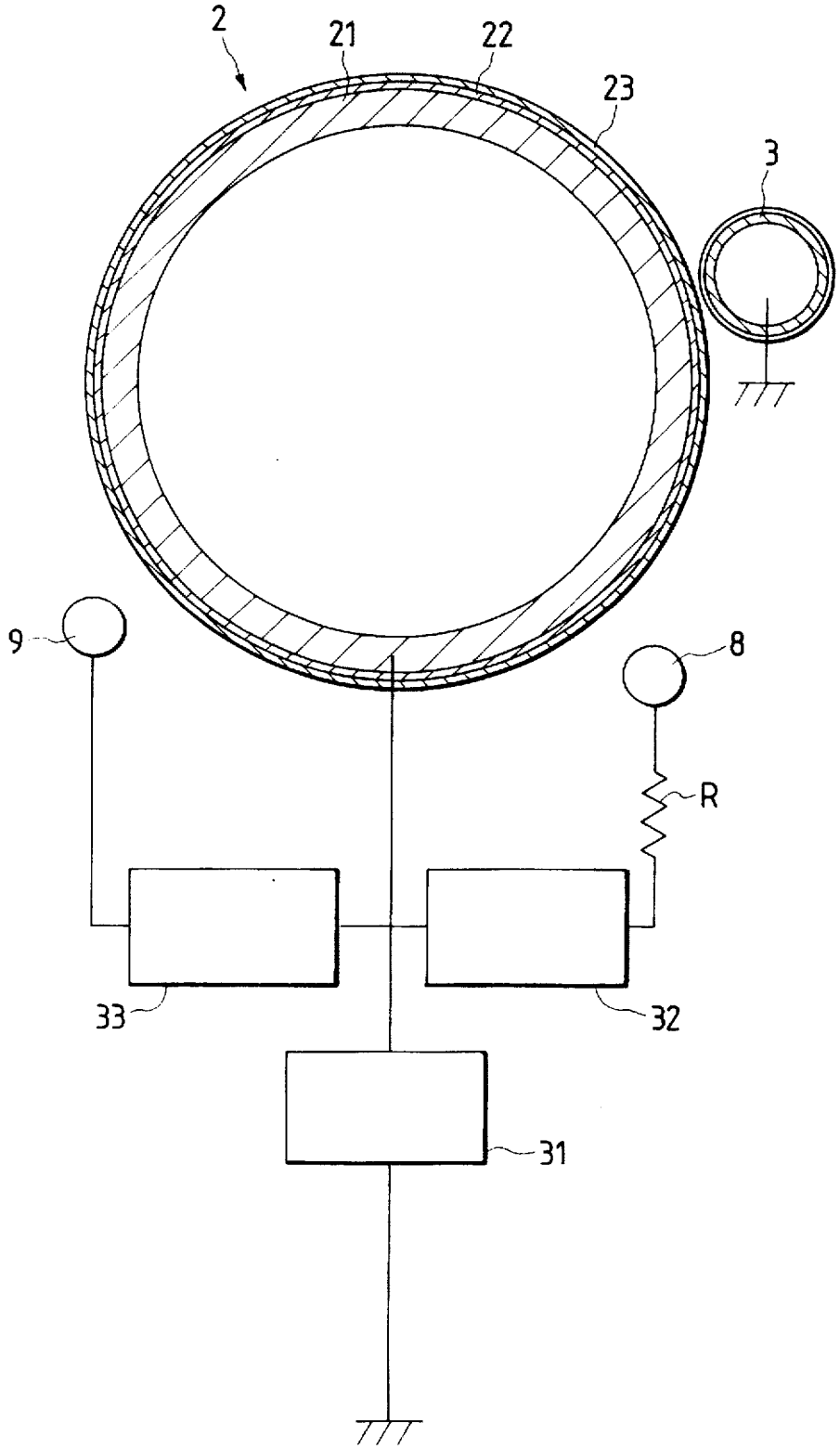
FIG. 1 is a schematic illustration showing a transfer portion of an image forming apparatus according to a first embodiment of the present invention.

In the first embodiment, as shown in FIG. 1, the aluminium core cylinder 21 of the transfer drum (transfer material bearing member) 2 is connected to a transfer power source (constant voltage source) 31, the attract roller (attract rotary member) 8 is connected to an attract power source 32, and the electricity removal roller 9 is connected to an electricity removal power source 33. Incidentally, the photosensitive drum (image bearing member) 3 has a negatively charged OPC layer, and a CT layer (charge transfer layer) having a thickness of 25 μm and provided on a charge generating layer. The transfer drum 2 comprises the above-mentioned aluminium core cylinder 21, an elastic layer 22 having a thickness of 5.5 mm and volume resistance of $10^5\Omega\cdot$cm or less and coated on the core cylinder, and a dielectric sheet (dielectric layer) 23 having a thickness of 75 μm, volume resistance of $10^{14}\Omega\cdot$cm to $10^{16}\Omega\cdot$cm and specific dielectric constant of 9 and coated on the elastic layer. Incidentally, in FIG. 1, although the attract roller 8 and the electricity removal roller 9 are shown to be spaced apart from the drum 2, they are contacted with the surface of the drum when the attracting operation and the electricity removing operation are effected, respectively.

The attract roller 8 comprises a core cylinder and an EPDM (tri-copolymer of ethylene/propylene/diene) layer having the volume resistance of $10^3\Omega$ and coated on the core cylinder, and, as shown in FIG. 1, a resistor having 100MΩis interposed between the core cylinder of the attract roller 8 and the attract power source 32. And, under an environment having temperature/humidity of 20° C./10%, the attract current was measured by changing the resistance of the transfer material, regarding the case where the resistor having 100MΩ is inserted into the attract circuit (illustrated embodiment) and the case where such resistor is not inserted into the attract circuit. Now, the attract bias voltage was set so that attract current becomes −6 μA when the resistance of the transfer material is $10^8\Omega$ (when the resistor having 100MΩ is inserted, the bias voltage becomes −1900V, and, when the resistor having 100MΩ is not inserted, the bias voltage becomes −1000V). The attract power source 32 is a constant voltage source capable of applying predetermined voltage to the attract roller 8.

Figure 2:
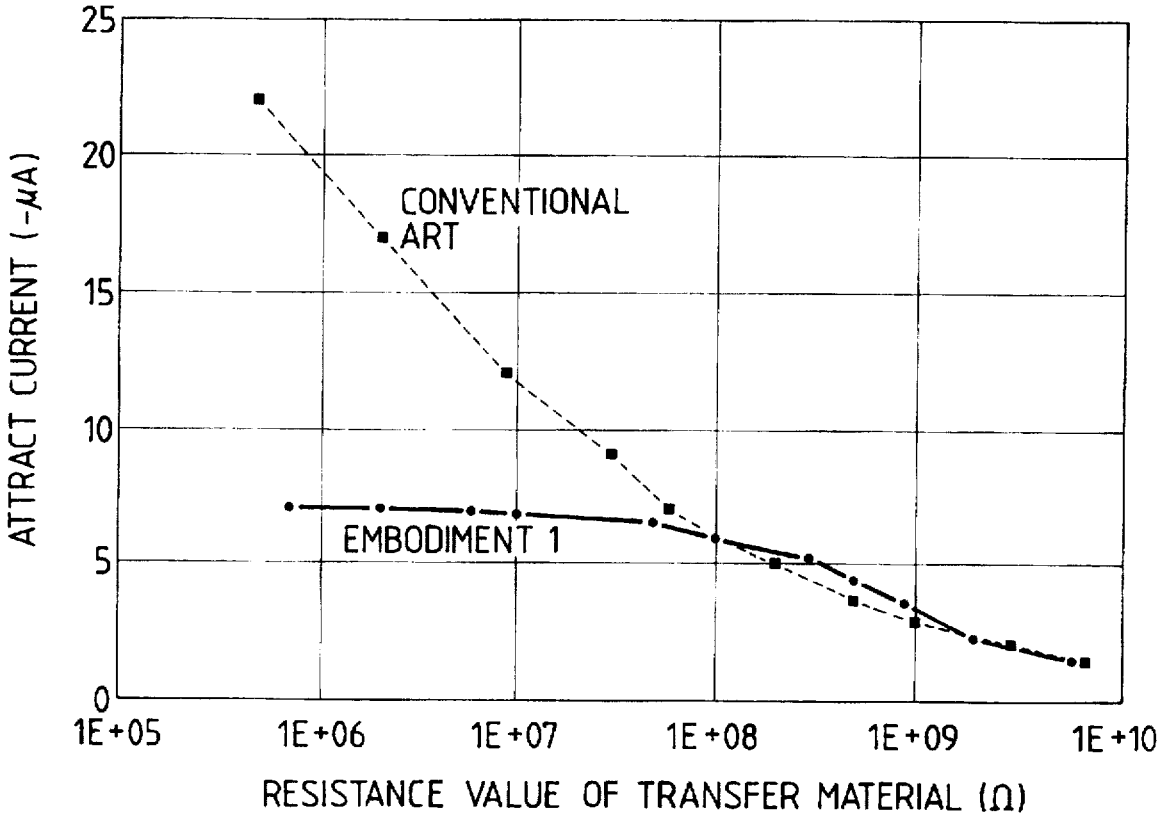
FIG. 2 is a graph showing a relation between a resistance value of a transfer material and attract current regarding the first embodiment of the present invention and a conventional art.

The measured result is shown in FIG. 2. The abscissa indicates the resistance of the transfer material and "1E+X" indicates $10^x$. As apparent from the graph shown in FIG. 2, in the conventional art, when the resistance of the transfer material is low, excessive attract current flew; to the contrary, in the illustrated embodiment, even when the resistance of the transfer material is low, the attract current could be suppressed to a proper amount.

Further, the resistor inserted into the attract circuit may be equal to or greater than the resistance of the transfer material. However, if the resistance value of the resistor is too great, since the attract bias voltage must be increased accordingly, the cost of the power source will be more expensive. Accordingly, it is preferable that the resistor inserted into the attract circuit has the resistance value of $10^6\Omega$ to $10^{10}\Omega$. With this arrangement, even when the resistance of the transfer material is changed regardless of the environmental temperature and humidity, the proper attract current can applied to the attract roller, thereby outputting the high quality image without poor image such as fog or poor transferring.

(Second embodiment)

Figure 3:
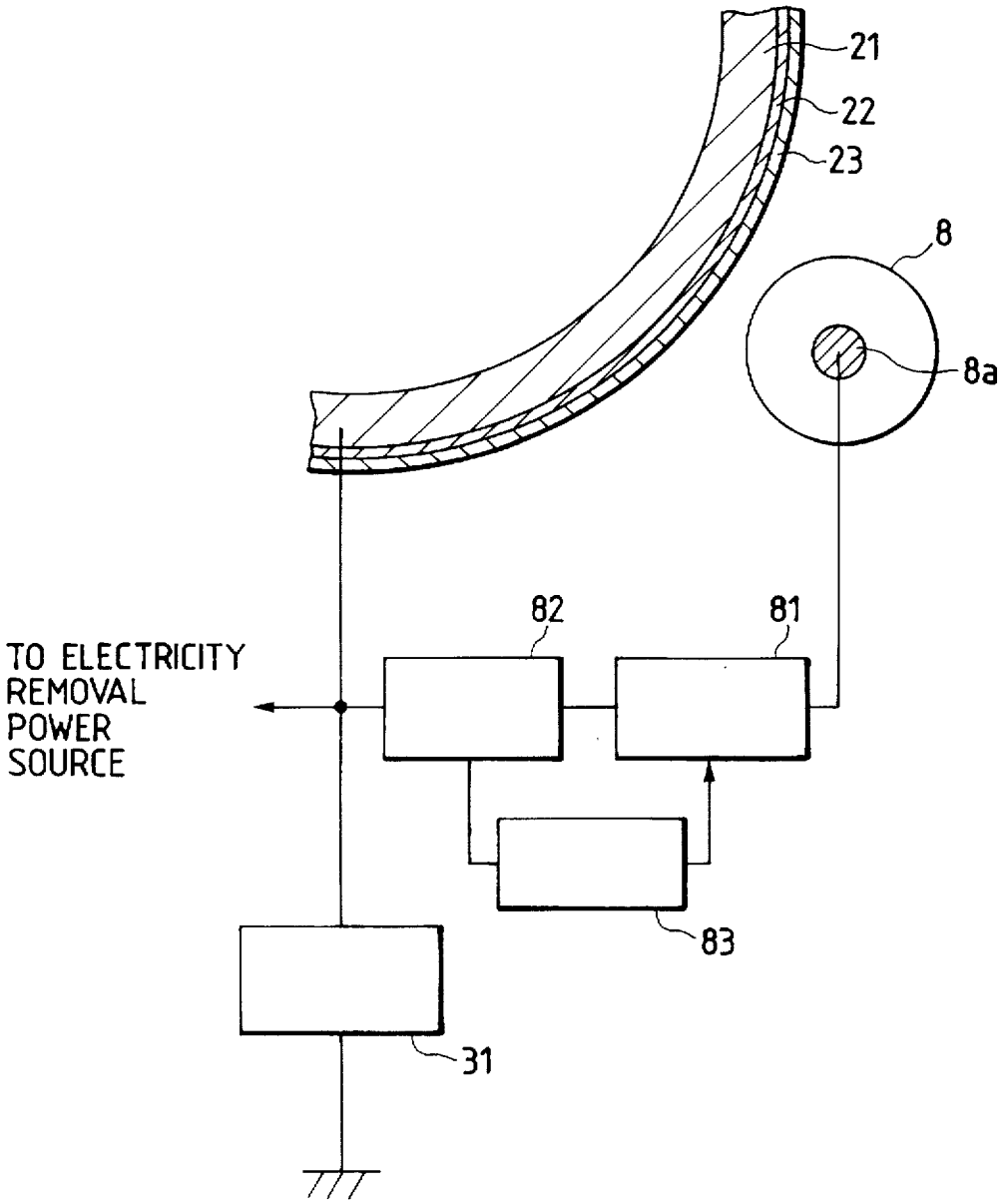
FIG. 3 is a schematic illustration showing a transfer portion of an image forming apparatus according to a second embodiment of the present invention.

Next, a second embodiment of the present invention will be explained with reference to FIG. 3. In this second embodiment, by applying the attract bias voltage by means of an attract constant voltage power source 81, the flow current is detected by a current detection means 82, so that the voltage is controlled not to exceed the reference current by means of a control circuit 83.

The photosensitive drum has a negatively charged OPC layer, and a CT layer (charge transfer layer) having a thickness of 25 μm and provided on a charge generating layer. The transfer drum comprises an aluminium core cylinder 21, an elastic layer 22 having a thickness of 5.5 mm and volume resistance of $10^5\Omega\cdot$cm or less and coated on the core cylinder, and a dielectric sheet 23 having a thickness of 75 μm, volume resistance of $10^{14}\Omega\cdot$cm to $10^{16}\Omega\cdot$cm and specific dielectric constant of 9 and coated on the elastic layer. The attract roller includes an EPDM (tri-copolymer of ethylene/propylene/diene) layer having the volume resistance of $10^3\Omega$, and, the attract bias voltage was set to 1000V and the reference current value was set to −6 μA.

Figure 4:
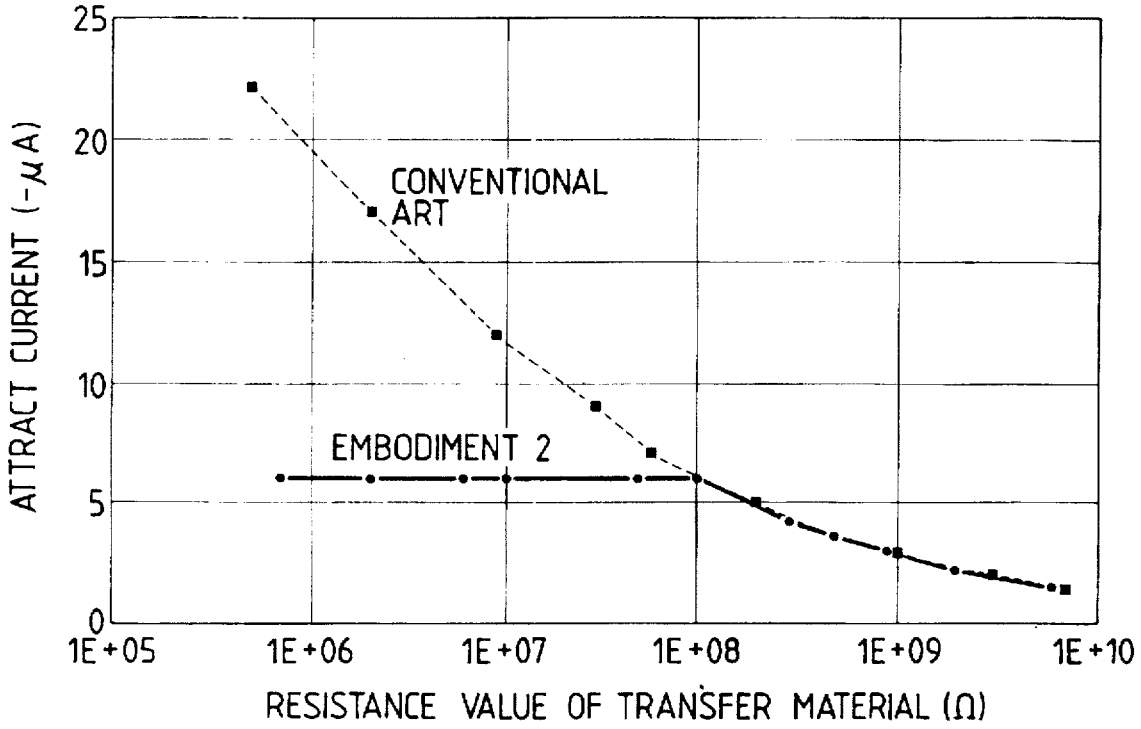
FIG. 4 is a graph showing a relation between a resistance value of a transfer material and attract current regarding the second embodiment of the present invention and a conventional art.

The measured result showing a relation between the resistance value of the transfer material and the attract current is shown in FIG. 4. With this arrangement, in this embodiment, even when the resistance value of the transfer material is small, the attract current can be suppressed to the optimum amount, and, since dispersion of the attract current can be more suppressed, the setting of the transfer bias can be facilitated with wider latitude.

(Third embodiment)

Figure 5:
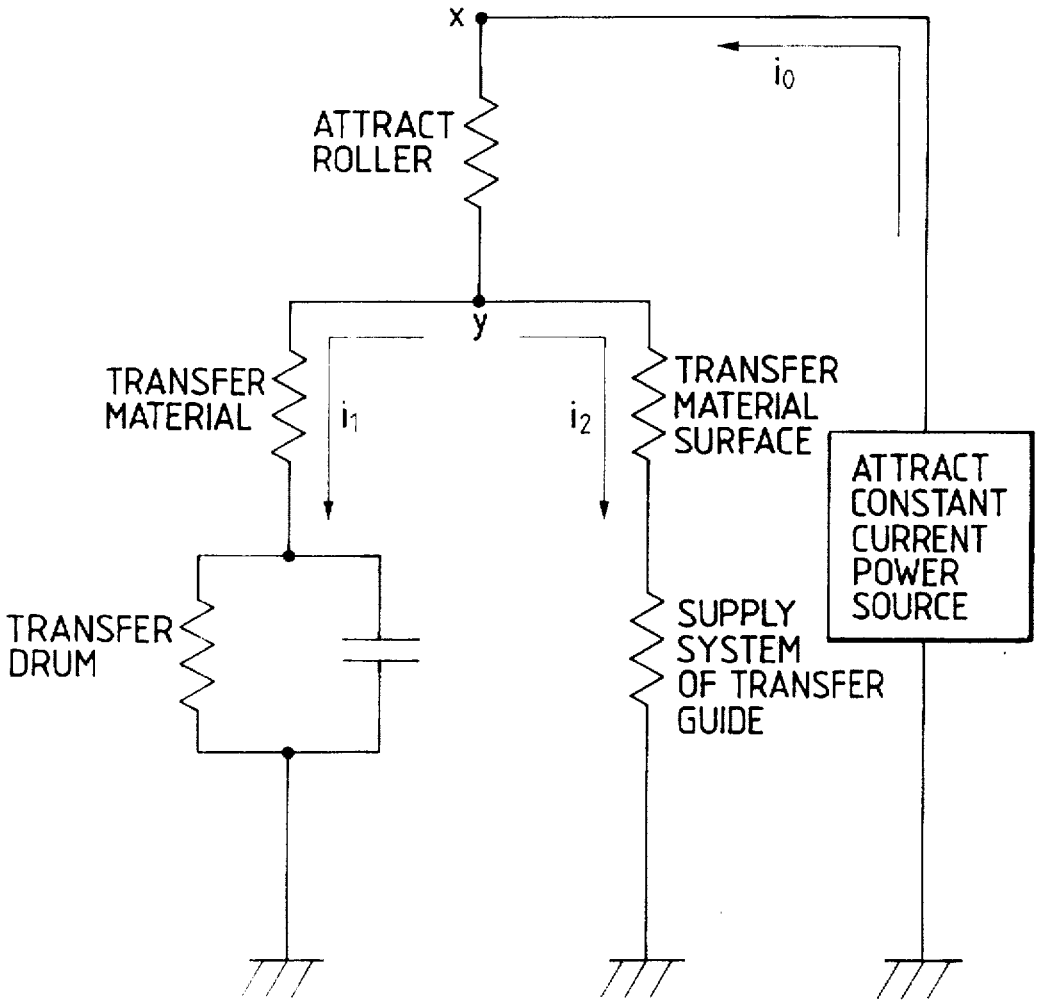
FIG. 5 is a model circuit showing flow of the attract current.

Next, a third embodiment of the present invention will be explained with reference to FIGS. 5 and 6. In this third embodiment, constant current control of the attract current is effected, and the voltage applied to the attract roller is controlled to be a predetermined voltage value or more.

As mentioned above, under the constant current control, when the transfer material having low resistance is passed through the image forming apparatus in a high temperature/humidity environment, the current leaks, through the transfer material, to any members such as a transfer guide with which the transfer material is contacted, with the result that, even when the predetermined current is applied, the desired charges cannot be generated on the transfer material, thereby causing the poor attracting. Explaining more in detail with reference to FIG. 5, the attract current to be controlled is current $i_1$ flowing toward the transfer drum. However, the actual current being controlled under the constant current control is current $i_0$ flowing through a point x in front of the attract roller, and this current is the sum of the current $i_1$ flowing toward the transfer drum and current $i_2$ flowing to a transfer guide/sheet supply system through the surface of the transfer material. When the resistance of the transfer material is relatively high, since the resistance of the transfer material surface is high, the current $i_2$ flowing to the transfer guide/sheet supply system is substantially zero, and, thus, the current $i_0$ becomes substantially the same as the current $i_1$, thereby permitting the current control.

However, if the resistance of the transfer material is decreased in the high temperature/humidity environment, the current $i_2$ will flow to the transfer guide/sheet supply system through the surface of the transfer material. Thus, the factors for controlling the current $i_0$ to determine the adequate attract current $i_1$ are the total impedance of the transfer material and the transfer drum, and a potential at a point y (potential of the surface of the attract roller). Accordingly, even when the resistance of the transfer material is low, so long as the potential at the point y is maintained to a predetermined value, the adequate attract current can be obtained.

Figure 6:
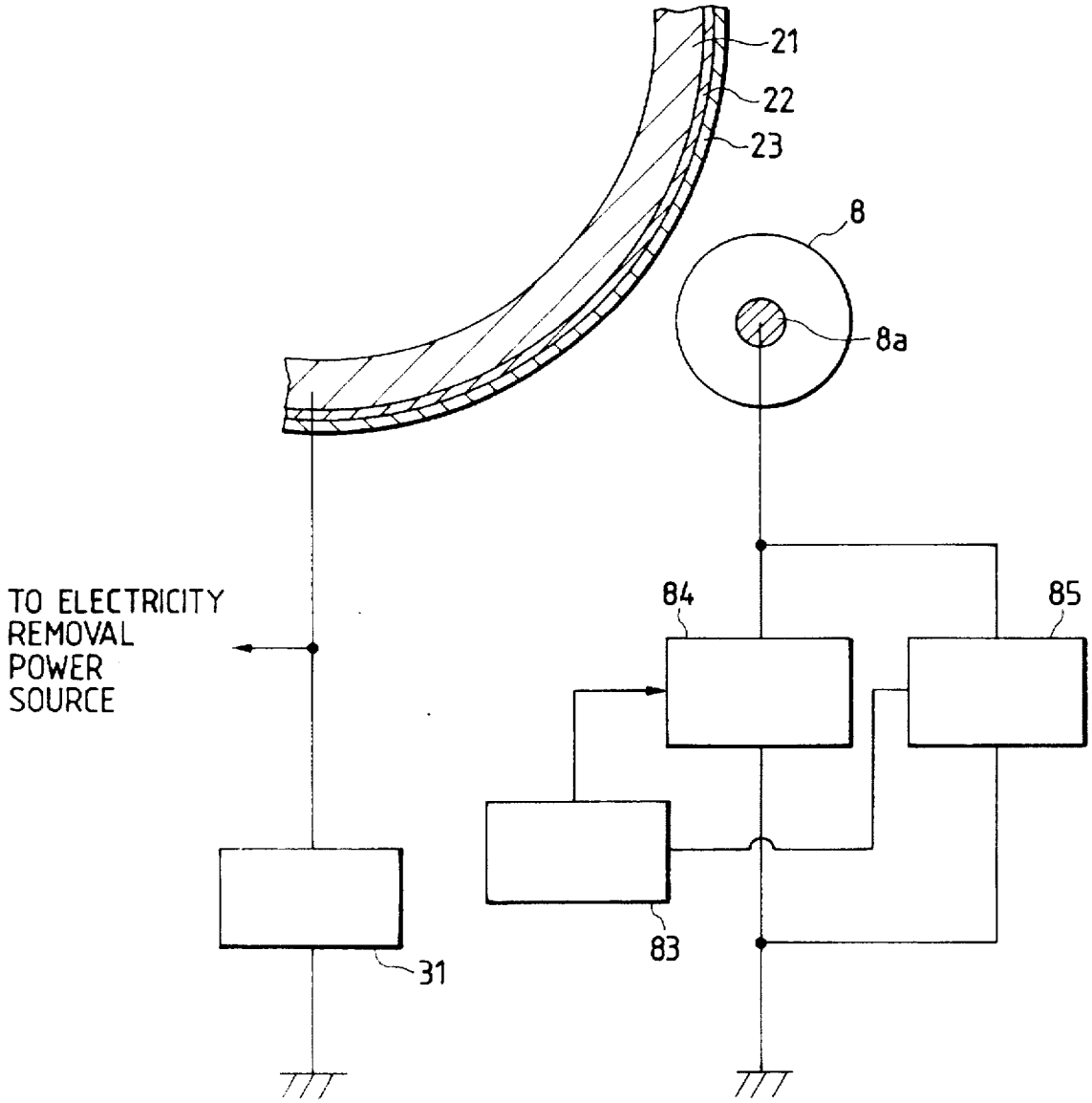
FIG. 6 is a schematic illustration showing a transfer portion of an image forming apparatus according to a third embodiment of the present invention.

In this third embodiment, as shown in FIG. 6, the attract current is supplied from an attract constant current power source 84, and the voltage applied to a core cylinder of the attract roller 8 is detected by a voltage detection means 85. As a result, when the predetermined voltage is not applied, a signal is fed back to the attract constant current control power source 84 through a control circuit so that the power source is controlled to provide the predetermined voltage. Further, an EPDM layer having the volume resistance of $10^3\Omega$ was used in the attract roller, the attract current value was set to −6 μA and the reference attract bias voltage was set to −500V. In this case, although the potential at the point x (potential of the core cylinder of the attract roller) is controlled, since the resistance of the attract roller is low, the potential at the point x becomes the substantially the same as the potential at the point y, thereby permitting the current control.

According to the third embodiment, the poor attracting under the high temperature/humidity condition can be prevented, and the constant attract current can be provided regardless of the resistance of the transfer material. Thus, the latitude of the transfer bias is further widened, and the image can always be outputted not only in the case where the resistance of the transfer material is low but also in the case where the resistance of the transfer material is high.

(Fourth embodiment)

Next, a fourth embodiment of the present invention will be explained with reference to FIGS. 7 and 8. In this fourth embodiment, unlike to the case where the resistor R is inserted between the roller 8 and the power source 32 as shown in FIG. 1, the resistance of the attract roller is set to $10^6\Omega$ to $10^{10}\ \Omega$, so that, as is in the aforementioned embodiments, the attract current can be suppressed to the proper amount even when the resistance value of the transfer material is small. Further, in the aforementioned embodiments, if the resistance of the attract roller is low, since the current leaks at an end of the transfer material through the surface of the attract roller 8, the amount of charges contributing to the attraction at the end of the transfer material becomes smaller than that at a central portion of the transfer material, with the result that the surface potential of the transfer drum 2 at the central portion of the transfer material differs from the surface potential at the end of the transfer material, thereby causing the poor image at the end of the transfer material. However, in the fourth embodiment, since the resistance value of the attract roller is equal to or greater than the resistance value of the transfer material, the leakage of the current at the end of the transfer material can be prevented.

Figure 7:
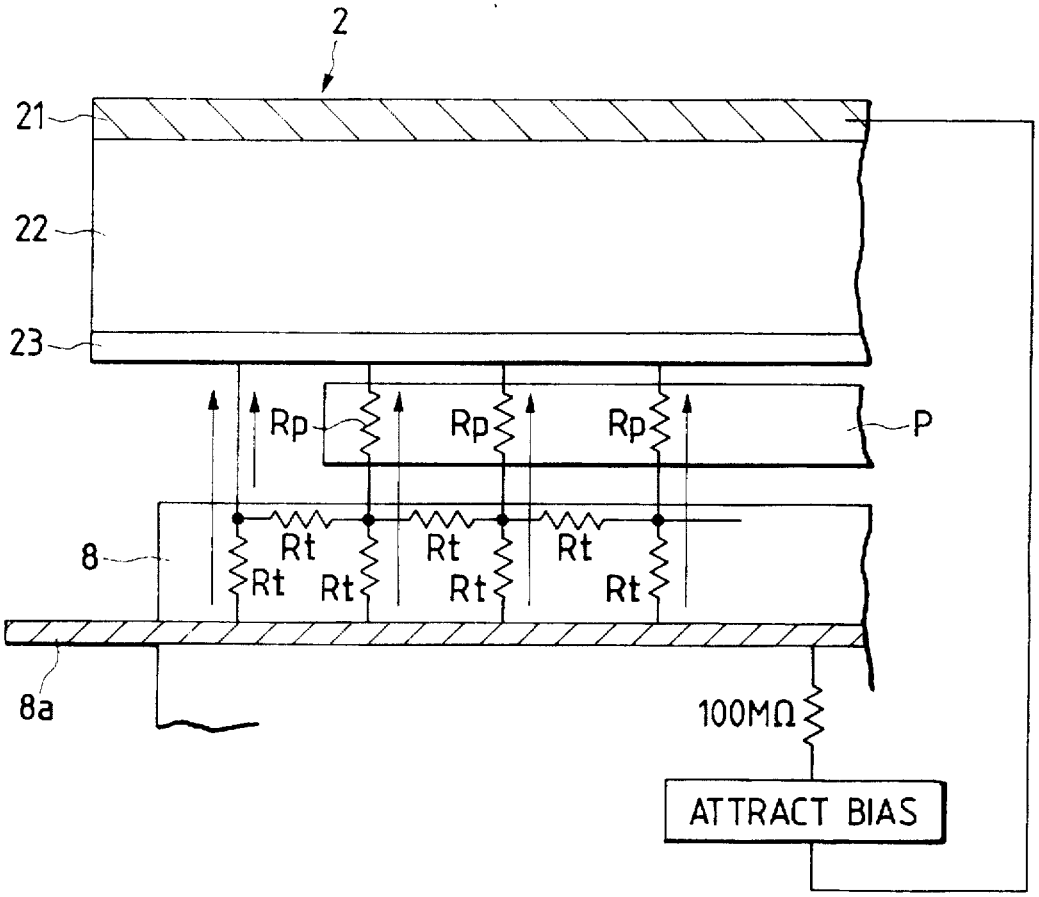
FIG. 7 is a model circuit showing flow of the attract current at an end of the transfer material of the first embodiment, in order to compare with a fourth embodiment of the present invention.
Figure 8:
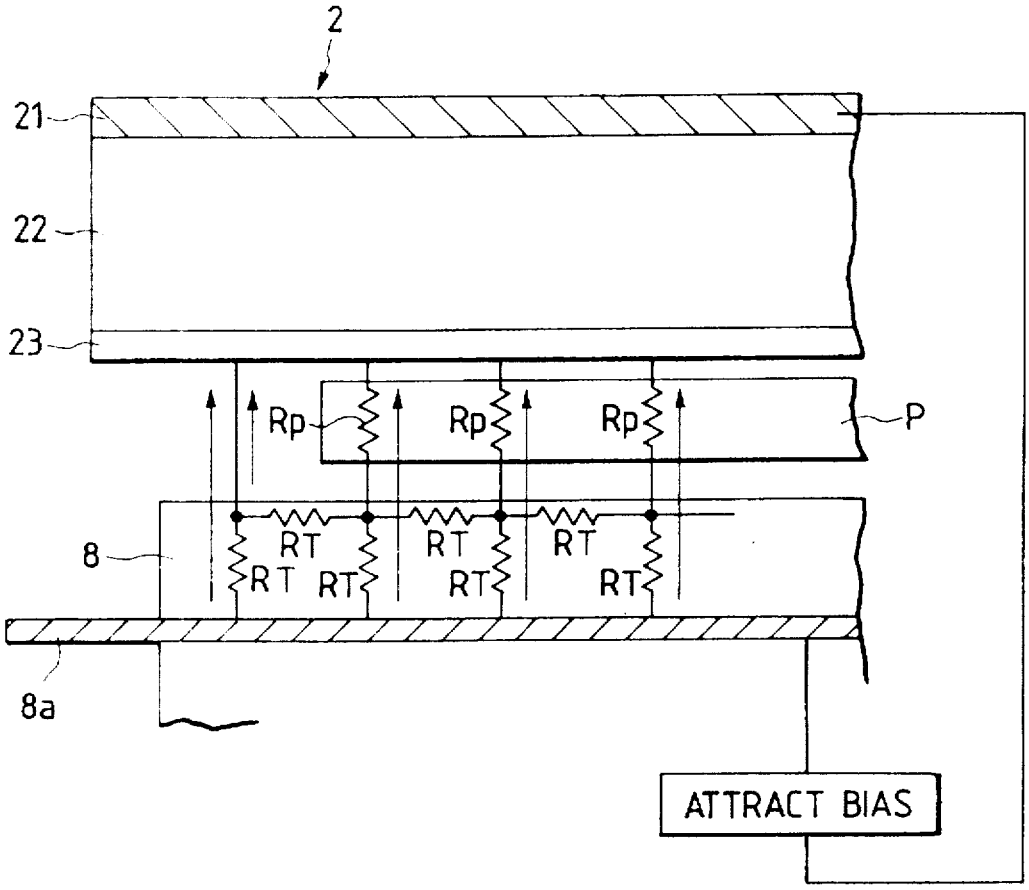
FIG. 8 is a model circuit showing flow of the attract current at an end of a transfer material of the fourth embodiment.

Detailed explanation will be continued with reference to FIGS. 7 and 8. In this embodiment, the EPDM layer having the volume resistance of $10^8\Omega$ was used in the attract roller 8. FIGS. 7 and 8 show model circuits showing flow of charges during the application of the attract bias according to the first and fourth embodiment, respectively. $R_p$ denotes resistances ($10^5\Omega$ to $10^{10}\Omega$) of the transfer material, Rt denotes resistances ($10^3\Omega$) of the attract roller 8 in the first embodiment, and RT denotes resistances ($10^8\Omega$) of the attract roller 8 in the fourth embodiment.

In the model circuit of the first embodiment shown in FIG. 7, since $Rt \ll R_p$, the charges leak out of the transfer material at the ends of the transfer material. On the other hand, in the model circuit of the fourth embodiment shown in FIG. 8, since $RT \geqq R_p$, the charges do not leak out of the transfer material. Although the resistance of the attract roller may be equal to or greater than the resistance of the transfer material, if the resistance of the attract roller is too high, since the higher attract bias is required accordingly, the cost of the power source will be more expensive. Thus, it is preferable that the resistance of the attract roller is $10^6\Omega$ to $10^{10}\Omega$.

As mentioned above, according to the illustrated embodiment, the attract current can be suppressed to the proper value even when the resistance value of the transfer material is small, and, since the proper charges can be provided at the ends of the transfer material, the high quality image can always be outputted.

Incidentally, the first to fourth embodiments can be combined appropriately.

What is claimed is:

1. An image forming apparatus comprising:

an image bearing member;

a transfer material bearing member for bearing a transfer material onto which an image can be transferred from said image bearing member;

an attract member for electrostatically attracting the transfer material to said transfer material bearing member; and a constant voltage control means for effecting a constant voltage control of said attract member with a predetermined voltage;

wherein a total impedance of an attract circuit including said attract member and said constant voltage control means is $10^6\Omega$ to $10^{10}\Omega$.

2. An image forming apparatus according to claim 1, wherein said transfer material bearing member includes a dielectric layer for forming an outer layer of said transfer material bearing member, and an electrode member which is disposed at an opposite side of said dielectric layer with respect to said image bearing member and to which the voltage is applied during the transferring of the image.

3. An image forming apparatus according to claim 2, wherein said electrode member is continuously disposed from an image transferring position to an attract position where the attracting is effected by said attract member.

4. An image forming apparatus according to claim 1, wherein said attract member is a rotary member, and during the attracting operation, the transfer material is passed between said transfer material bearing member and said rotary member.

5. An image forming apparatus according to claim 1, wherein resistance of said attract member is $10^6\Omega$ to $10^{10}\Omega$.

6. An image forming apparatus according to claim 1, wherein a plurality of different color images are transferred onto the transfer material born on said transfer material bearing member in a superimposed fashion.

7. An image forming apparatus comprising:

an image bearing member;

a transfer material bearing member for bearing a transfer material onto which an image can be transferred from said image bearing member;

an attract member for electrostatically attracting the transfer material to said transfer material bearing member;

a constant voltage control means for effecting constant voltage control of said attract member with predetermined voltage; and a restricting means for restricting current flowing to said attract member so that the current does not exceed a predetermined value.

8. An image forming apparatus according to claim 7, wherein said transfer material bearing member includes a dielectric layer for forming an outer layer of said transfer material bearing member, and an electrode member which is disposed at an opposite side of said dielectric layer with respect to said image bearing member and to which the voltage is applied during the transferring of the image.

9. An image forming apparatus according to claim 8, wherein said electrode member is continuously disposed from an image transferring position to an attract position where the attracting is effected by said attract member.

10. An image forming apparatus according to claim 7, wherein said attract member is a rotary member, and during the attracting operation, the transfer material is passed between said transfer material bearing member and said rotary member.

11. An image forming apparatus according to claim 7, wherein resistance of said attract member is $10^6\Omega$ to $10^{10}\Omega$.

12. An image forming apparatus according to claim 7, wherein a plurality of different color images are transferred onto the transfer material born on said transfer material bearing member in a superimposed fashion.

13. An image forming apparatus comprising:

an image bearing member;

a transfer material bearing member for bearing a transfer material onto which an image can be transferred from said image bearing member;

an attract member for electrostatically attracting the transfer material to said transfer material bearing member;

a constant current control means for effecting a constant current control of current flowing to said attract member; and a second control means for restricting voltage applied to said attract member so that the voltage exceeds a predetermined value.

14. An image forming apparatus according to claim 13, wherein said transfer material bearing member includes a dielectric layer for forming an outer layer of said transfer material bearing member, and an electrode member which is disposed at an opposite side of said dielectric layer with respect to said image bearing member and to which the voltage is applied during the transferring of the image.

15. An image forming apparatus according to claim 14, wherein said electrode member is continuously disposed from an image transferring position to an attract position where the attracting is effected by said attract member.

16. An image forming apparatus according to claim 13, wherein said attract member is a rotary member, and during the attracting operation, the transfer material is passed between said transfer material bearing member and said rotary member.

17. An image forming apparatus according to claim 13, wherein resistance of said attract member is $10^6\Omega$ to $10^{10}\Omega$.

18. An image forming apparatus according to claim 13, wherein a plurality of different color images are transferred onto the transfer material born on said transfer material bearing member in a superimposed fashion.

* * * * *

UNITED STATES PATENT AND TRADEMARK OFFICE

CERTIFICATE OF CORRECTION

PATENT NO. : 5,761,571

DATED : June 2, 1998

INVENTOR(S) : TAKEHIKO SUZUKI, ET AL.

It is certified that error appears in the above-identified patent and that said Letters Patent is hereby corrected as shown below:

COLUMN 4,
Line 41, "100MΩis" should read --100MΩ is--.

COLUMN 6,
Line 4, "to the" should read --in the--; and
Line 27, "the substantially" should read --substantially--.

COLUMN 8,
Line 6, "current" should read --a current--; and
Line 38, "current" should read --a current--.

Signed and Sealed this

Twenty-second Day of June, 1999

*Attest:*

Q. TODD DICKINSON

*Attesting Officer*

*Acting Commissioner of Patents and Trademarks*